US009543652B2

(12) United States Patent
Lu et al.

(10) Patent No.: US 9,543,652 B2
(45) Date of Patent: Jan. 10, 2017

(54) LOOP ANTENNA

(71) Applicant: Wistron NeWeb Corp., Hsinchu (TW)

(72) Inventors: Chin-Shih Lu, Hsinchu (TW); Liang-Kai Chen, Hsinchu (TW); Chih-Chun Peng, Hsinchu (TW); Wei-Hung Liu, Hsinchu (TW); Mei Tien, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 242 days.

(21) Appl. No.: 14/294,894

(22) Filed: Jun. 3, 2014

(65) Prior Publication Data

US 2015/0145746 A1 May 28, 2015

(30) Foreign Application Priority Data

Nov. 22, 2013 (TW) ..... 102142578 A

(51) Int. Cl.
*H01Q 7/00* (2006.01)
*H01Q 1/38* (2006.01)

(52) U.S. Cl.
CPC . *H01Q 7/00* (2013.01); *H01Q 1/38* (2013.01)

(58) Field of Classification Search
CPC ..... H01Q 21/00; H01Q 7/00; H01Q 1/38
USPC . 343/867, 866, 860, 861, 741, 742; 257/531
See application file for complete search history.

(56) References Cited

U.S. PATENT DOCUMENTS 1,747,262 A * 2/1930 Pressley ..... G01S 3/06 342/420
6,995,729 B2 * 2/2006 Govari ..... H01Q 7/00 343/867
7,728,785 B2 * 6/2010 Ozden ..... H01Q 1/243 343/866
7,876,284 B2 * 1/2011 Mizoroki ..... G06K 19/07749 343/742
8,599,094 B2 * 12/2013 Lee ..... H01Q 1/52 343/866
8,854,269 B2 * 10/2014 Bortoin ..... 343/713
8,907,447 B2 * 12/2014 Wang ..... H01L 28/10 257/531
2012/0145794 A1 * 6/2012 Mieslinger ..... G06K 19/07749 235/488

* cited by examiner

*Primary Examiner* — Huedung Mancuso
(74) *Attorney, Agent, or Firm* — Muncy, Geissler, Olds & Lowe, P.C.

(57) ABSTRACT

A loop antenna is provided, which includes a first loop section, a second loop section and a third loop section. The first loop section surrounds and defines an empty area. The second loop section surrounds and connects the first loop section, and an annular groove is formed between the first loop section and the second loop section. The third loop section surrounds and connects the second loop section. The width of a gap between the third loop section and the second loop section is smaller than the width of the annular groove.

13 Claims, 9 Drawing Sheets

LOOP ANTENNA

CROSS REFERENCE TO RELATED APPLICATIONS

This Application claims priority of Taiwan Patent Application No. 102142578, filed on Nov. 22, 2013, the entirety of which is incorporated by reference herein.

BACKGROUND OF THE INVENTION

Field of the Invention

The present invention relates to a loop antenna, and in particular to a loop antenna with a radiation field that is more symmetrical in different directions.

Description of the Related Art

Near-field communication antennas are commonly utilized in portable electronic devices or cards, which provide non-contacting data matching, data exchanging or payment. Restricted by the dimensions of the carriers (for example, cell phones or credit cards), near-field communication antennas are rectangular. Therefore, as shown in FIG. 1, in a field density test, the radiation energy of near-field communication antennas decays in directions of 90 degrees and 270 degrees.

BRIEF SUMMARY OF THE INVENTION

A loop antenna is provided, which includes a first loop section, a second loop section and a third loop section. The first loop section surrounds and defines an empty area. The second loop section surrounds and connects the first loop section, and an annular groove is formed between the first loop section and the second loop section. The third loop section surrounds and connects the second loop section, wherein the width of a gap between the third loop section and the second loop section is smaller than the width of the annular groove.

In the embodiment of the invention, the annular groove increases the resonance of the magnetic field to increase radiation of the antenna in the directions of 90 degrees and 270 degrees. Utilizing the loop antenna of the embodiment of the invention, in a field density test, in the directions of 90 degrees and 270 degrees, the radiation energy of the antenna is increased, and a more symmetrical radiation field is provided.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
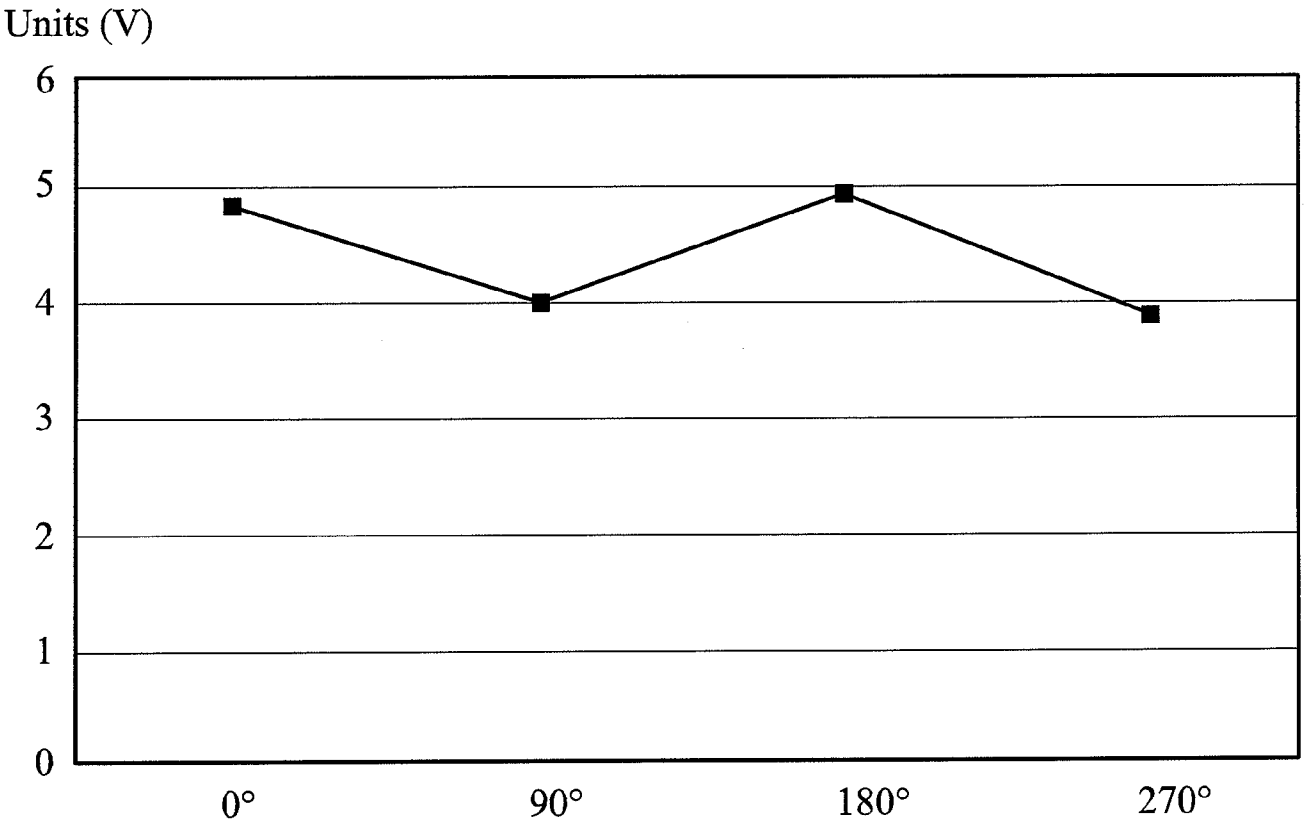
FIG. 1 shows a field density test result of a conventional loop antenna.
Figure 2A:
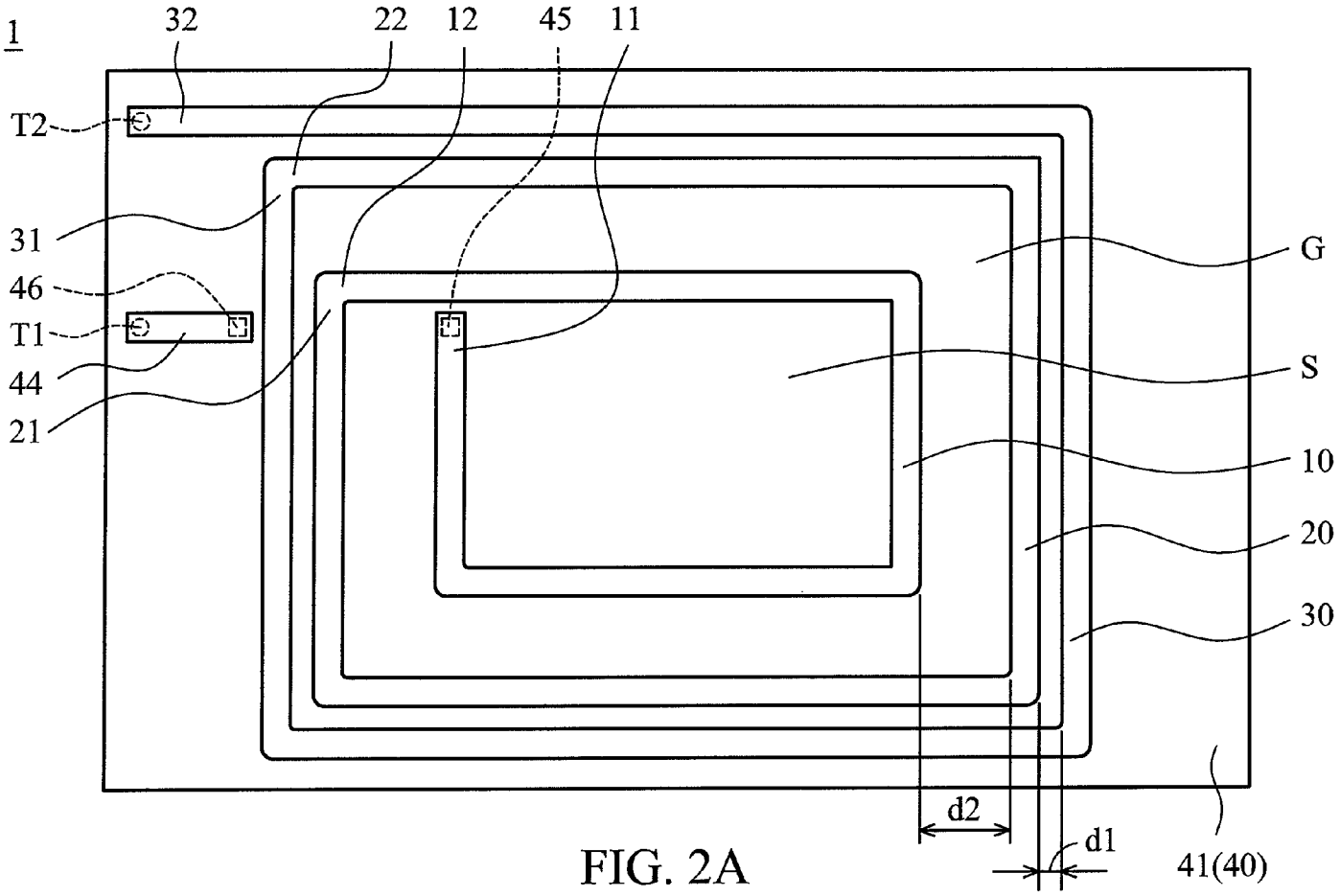
FIGS. 2A and 2B show a loop antenna of an embodiment of the invention.

FIG. 2A shows a loop antenna 1 of an embodiment of the invention, comprising a first loop section 10, a second loop section 20 and a third loop section 30. The first loop section 10 surrounds and defines an empty area S. The second loop section 20 surrounds the first loop section 10. An annular groove G is formed between the first loop section 10 and the second loop section 20. The third loop section 30 surrounds and is connected to the second loop section 20. A width of a gap between the third loop section 30 and the second loop section 20 is smaller than a width of the annular groove G. As shown in FIG. 2A, the width d2 of the annular groove G is greater than the width d1 of the gap between the third loop section 30 and the second loop section 20.

Figure 2C:
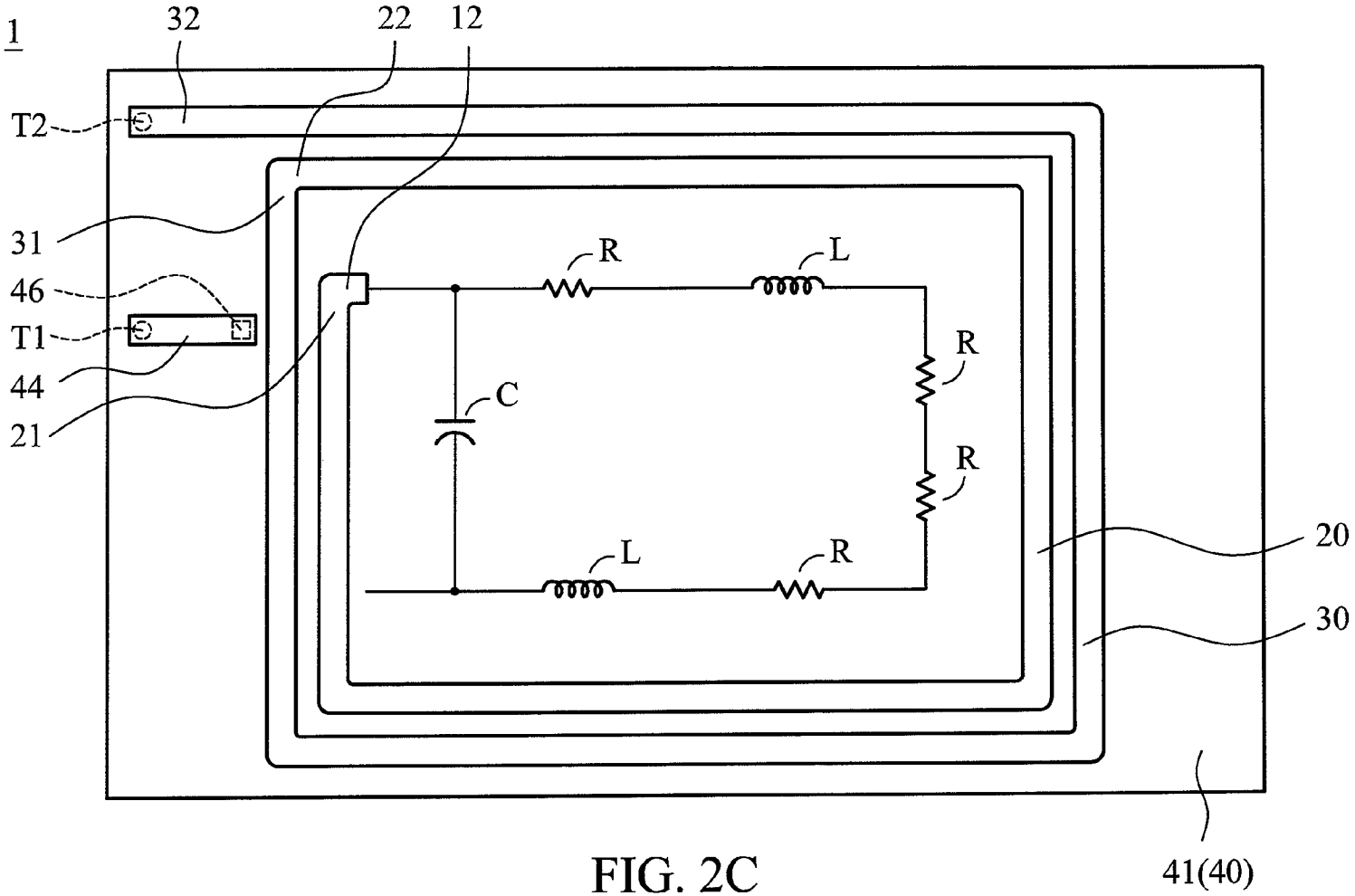
FIG. 2C shows an equivalent circuit of the loop antenna of the embodiment of the invention.
Figure 3:
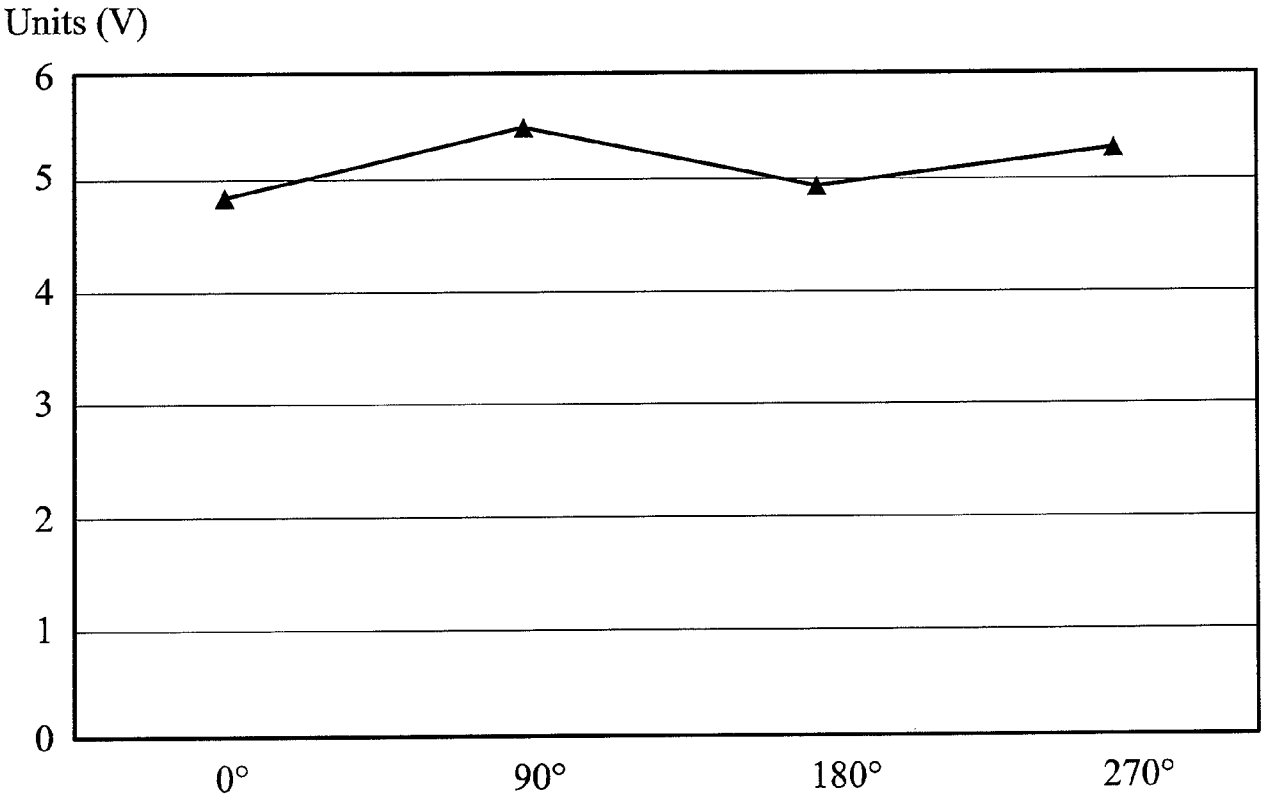
FIG. 3 shows a field density test result of the loop antenna of the embodiment of the invention.

In the embodiment of the invention, the annular groove G increases the resonance of the magnetic field to increase radiation of the antenna in the directions of 90 degrees and 270 degrees. With reference to FIG. 3, utilizing the loop antenna 1 of the embodiment of the invention, in a field density test, in the directions of 90 degrees and 270 degrees, the radiation energy of the antenna is increased, and a more symmetrical radiation field is provided. In this embodiment, the width d1 of the gap between the third loop section 30 and the second loop section 20 is smaller than 1 mm. The width d2 of the annular groove G is substantially between 1 mm~10 mm. In another embodiment, the width d2 of the annular groove G is substantially between 2 mm~7 mm. FIG. 2C shows an equivalent circuit of the loop antenna of an embodiment of the invention, wherein the inductors and the resistors are connected in series. The mutual inductance and the capacitance of the antenna are modified by changing the structure of the antenna, and the efficiency of the antenna is increased.

With reference to FIG. 2A, the first loop section 10 comprises a first end 11 and a second end 12. The second loop section 20 comprises a third end 21 and a fourth end 22. The third end 21 is connected to the second end 12. The third loop section 30 comprises a fifth end 31 and a sixth end 32. The fifth end 31 is connected to the fourth end 22.

Figure 2B:
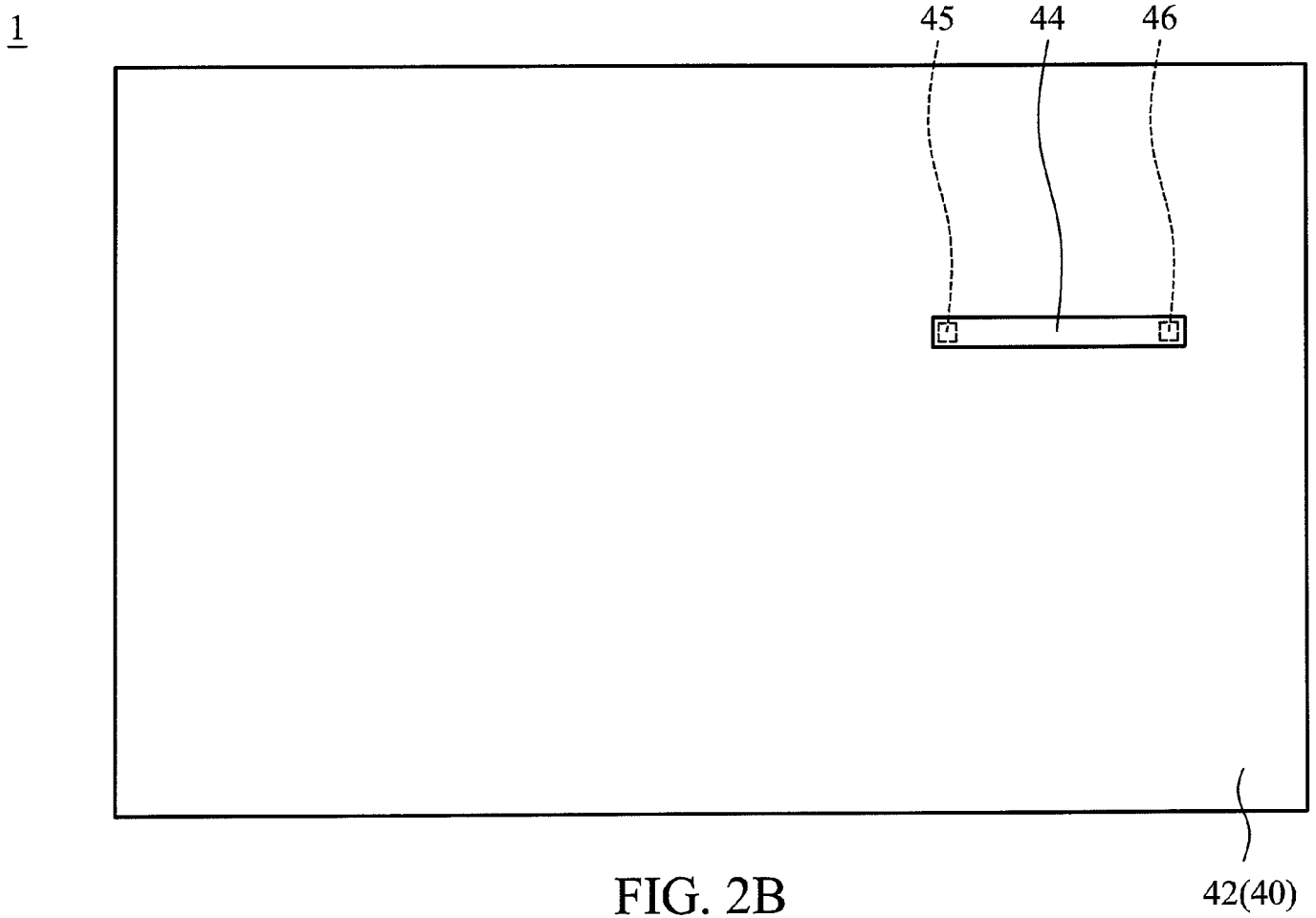

With reference to FIGS. 2A and 2B, the loop antenna 1 further comprises a substrate 40. The substrate 40 comprises a first surface 41 and a second surface 42 opposite to the first surface 41. The first loop section 10, the second loop section 20 and the third loop section 30 are formed on the first surface 41 of the substrate 40. A feeding via hole 45 and a feed line 44 are formed on the substrate 40. At least a portion of the feed line 44 is formed on the second surface 42, the first end 11 is coupled to the feed line 44 through the feeding via hole 45. In this embodiment, the feed line 44 extends from the second surface 42 to the first surface 41 through a feeding via hole 46. A first feed point T1 is located on an end of the feed line 44, and a second feed point T2 is located on the sixth end 32. With the structure mentioned above, the feed line 44 detours round the second loop section 20 and the third loop section 30 without interference therewith.

Figure 4:
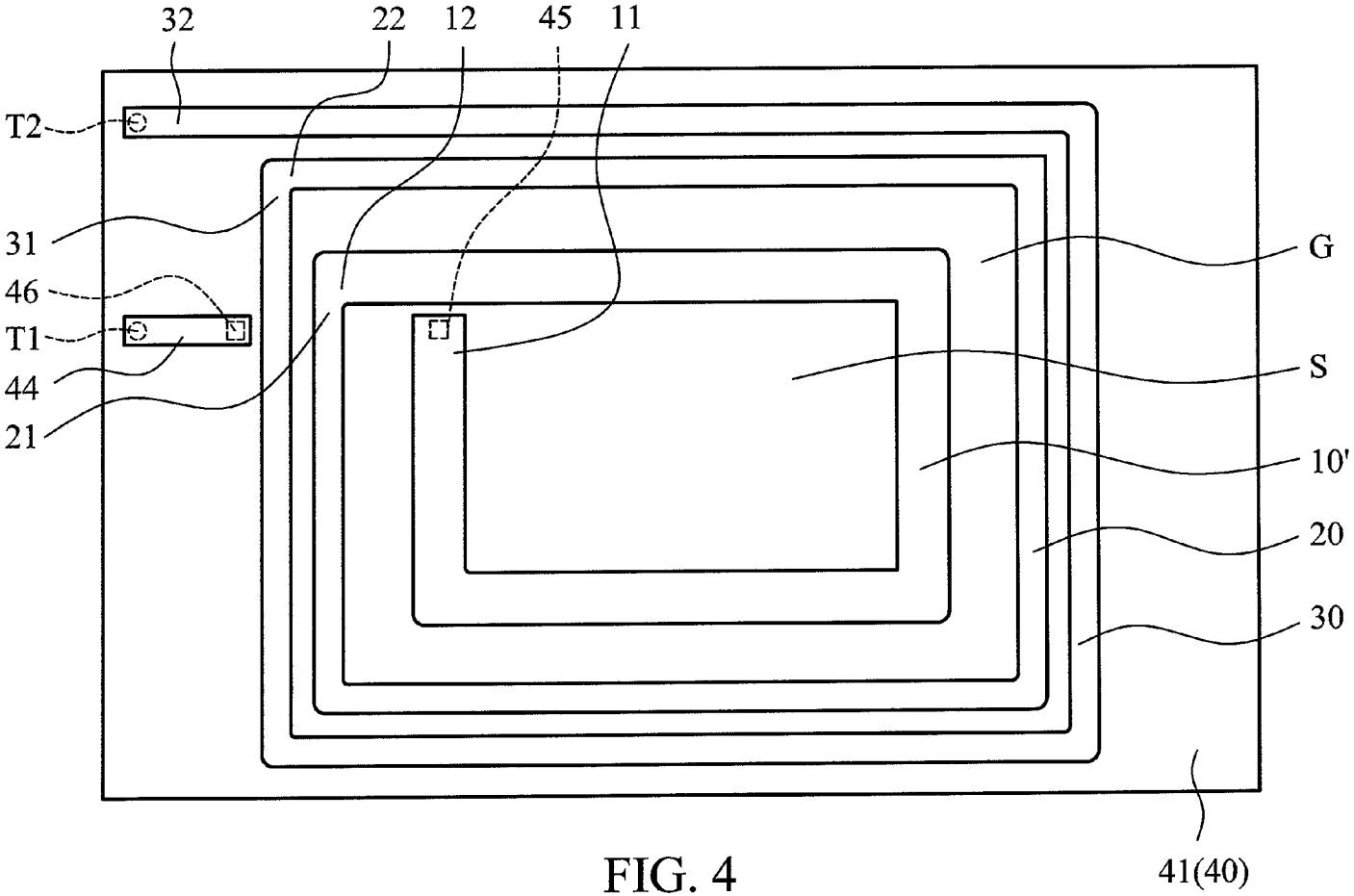
FIG. 4 shows a loop antenna of another embodiment of the invention.

FIG. 4 shows a loop antenna of another embodiment of the invention, wherein a line width of the first loop section 10' is greater than a line width of the second loop section 20. In this embodiment, the loop antenna with a more symmetrical radiation field is achieved.

Figure 5:
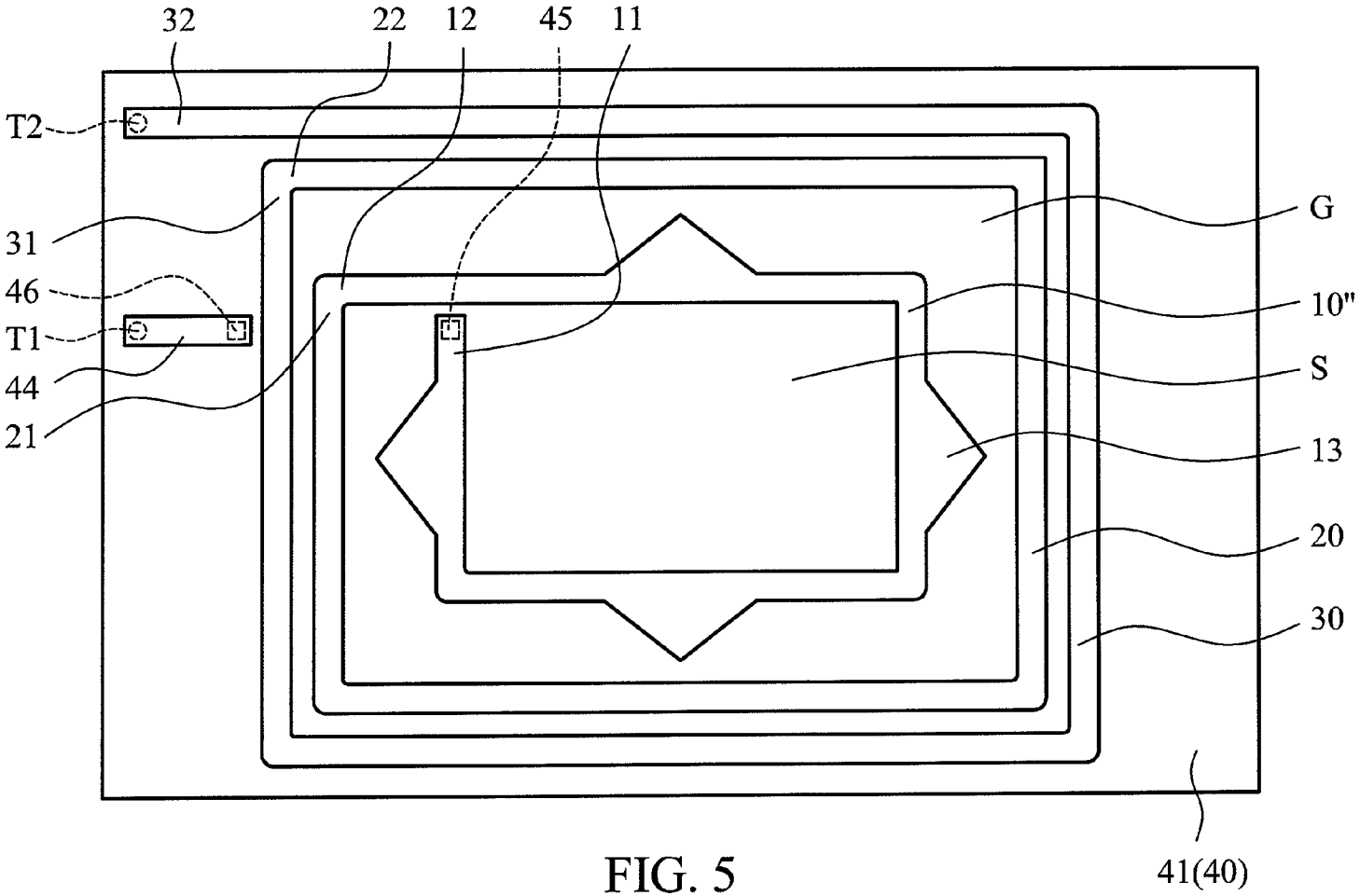
FIG. 5 shows a loop antenna of further another embodiment of the invention.

FIG. 5 shows a loop antenna of further another embodiment of the invention, wherein the first loop section 10" further comprises a plurality of parasitic structures 13, and the parasitic structures 13 are located on four sides of the first loop section 10", and are located in the annular groove G. In this embodiment, the loop antenna with a more symmetrical radiation field is achieved. The parasitic structures 13 can be triangular or another appropriate shape.

In the embodiment of the invention, the loop antenna is a rectangular structure, and the loop sections are extended along rectangular paths. The empty area can be square or rectangular. The annular groove is a rectangular annular groove. However, the invention is not limited to the disclosure above. The shape of the loop antenna and the shapes of the sections of the loop antenna can be modified if required.

In one embodiment of the invention, a measure of the empty area is about ¼~⅙ of a measure of an area of the entire loop antenna. In one embodiment of the invention, a measure of the empty area is about ⅕~⅙ of a measure of an area of the entire loop antenna. In one embodiment of the invention, the empty area can be a square with a dimension of 20 mm*20 mm.

Figure 6A:
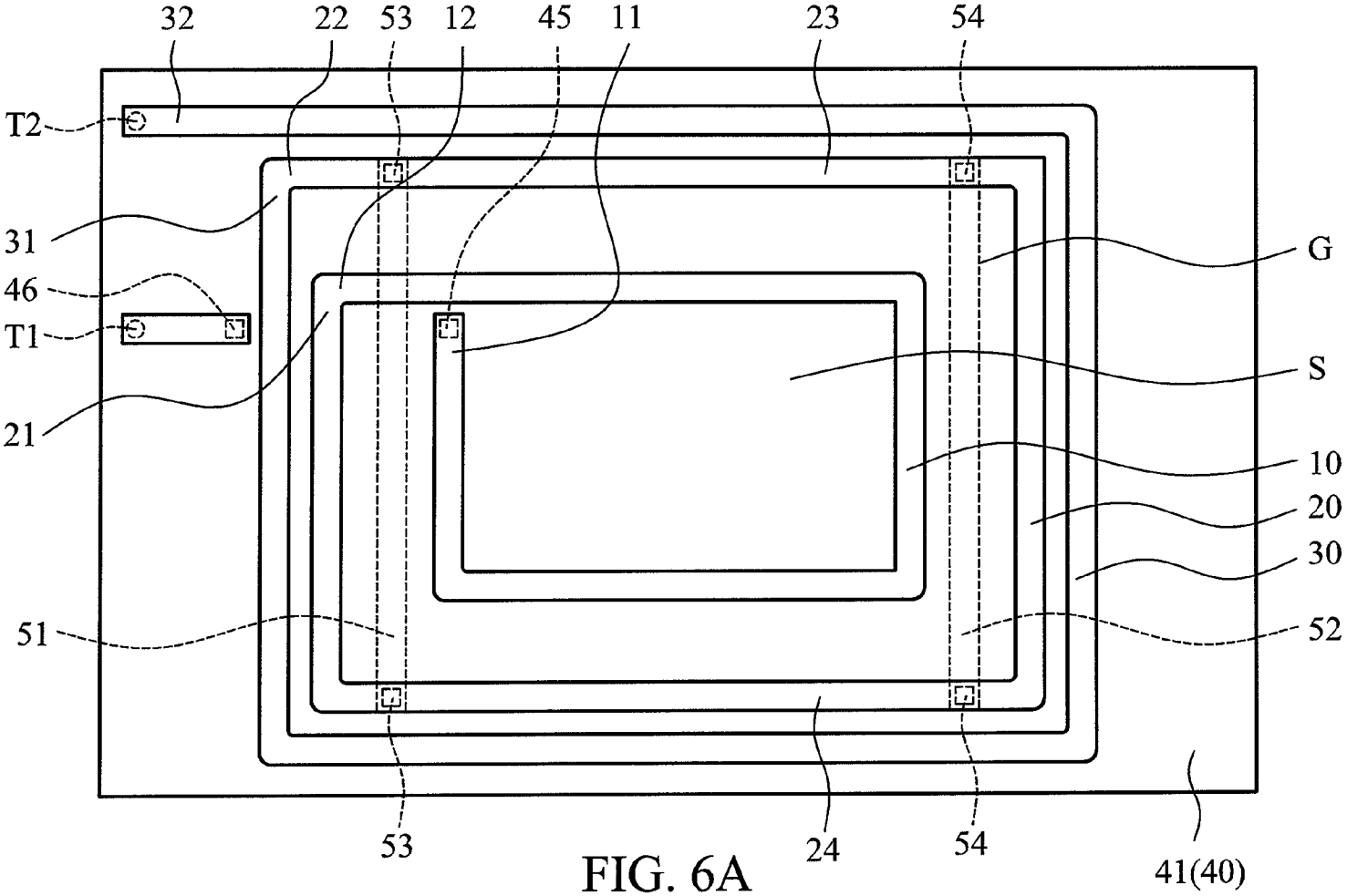
FIGS. 6A and 6B show a loop antenna of a modified embodiment of the invention.
Figure 6B:
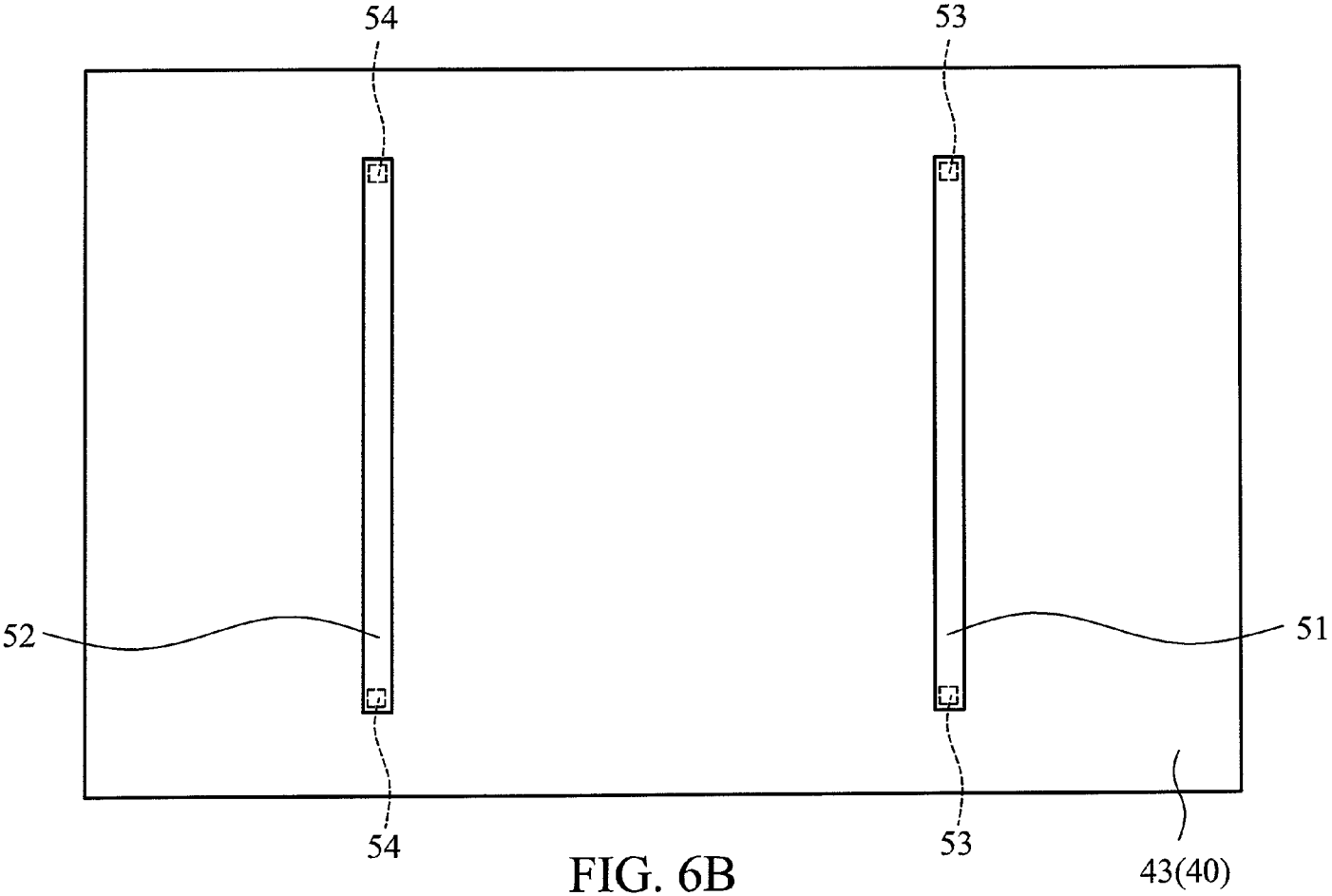

FIGS. 6A and 6B shows a loop antenna of another modified embodiment of the invention, which comprises a first short element 51 and a second short element 52. The second loop section 20 is rectangular and comprises a first major side 23 and a second major side 24. The first major side 23 is parallel to the second major side 24. The first short element 51 is connected to the first major side 23 and the second major side 24. The second short element 52 is connected to the first major side 23 and the second major side 24. The empty area S is located between the first short element 51 and the second short element 52. In this embodiment, the substrate 40 can be multilayer board with a third surface 43. The first short element 51 and the second short element 52 can be located on the third surface 43, and are coupled to the first major side 23 and the second major side 24 through via holes 53 and via holes 54. In this embodiment, the loop antenna with a more symmetrical radiation field is achieved.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term).

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A loop antenna, comprising:

a first loop section, comprising a first end and a second end, wherein the first loop section surrounds and defines an empty area;

a second loop section, comprising a third end and a fourth end, the third end is connected to the second end, wherein the second loop section surrounds the first loop section, an annular groove is formed between the first loop section and the second loop section, the annular groove surrounds the first loop section in a rectangular path and has four sides, and a width of the annular groove is between 1 mm and 10 mm;

a third loop section, comprising a fifth end and a sixth end, the fifth end connected to the fourth end, wherein the third loop section surrounds the second loop section, and a width of a gap between the third loop section and the second loop section is smaller than the width of each of the four sides of the annular groove; and a first short element and second short element, wherein the second loop section is rectangular and comprising a first major side and a second major side, the first major side is parallel to the second major side, the first short element is connected to the first major side and the second major side, the second short element is connected to the first major side and the second major side, and the empty area is located between the first short element and the second short element.

2. The loop antenna as claimed in claim 1, wherein the width of the annular groove is between 2 mm and 7 mm.

3. The loop antenna as claimed in claim 1, wherein the width of the gap between the third loop section and the second loop section is smaller than 1 mm.

4. The loop antenna as claimed in claim 1, further comprising a substrate, the substrate comprising a first surface and a second surface opposite to the first surface, wherein the first loop section, the second loop section and the third loop section are formed on the first surface of the substrate, a feeding via hole and a feed line are formed on the substrate, at least a portion of the feed line is formed on the second surface, the first end is coupled to the feed line through the feeding via hole, a first feed point is located on an end of the feed line, and a second feed point is located on the sixth end.

5. The loop antenna as claimed in claim 1, wherein a line width of the first loop section is greater than a line width of the second loop section.

6. The loop antenna as claimed in claim 1, wherein the empty area is rectangular, and the annular groove is a rectangular annular groove.

7. A loop antenna, comprising:

a first loop section, comprising a first end and a second end, wherein the first loop section surrounds and defines an empty area, a measure of the empty area is about ¼~⅙ of a measure of an area of the entire loop antenna;

a second loop section, comprising a third end and a fourth end, the third end is connected to the second end, wherein the second loop section surrounds the first loop section, and an annular groove is formed between the first loop section and the second loop section, the annular groove surrounds the first loop section in a rectangular path and has four sides; and a third loop section, comprising a fifth end and a sixth end, the fifth end connected to the fourth end, wherein the third loop section surrounds the second loop section, and a width of a gap between the third loop section and the second loop section is smaller than a width of each of the four sides of the annular groove, wherein the first loop section further comprises a parasitic structure, and the parasitic structure is located in the annular groove.

8. The loop antenna as claimed in claim 7, wherein the measure of the empty area is about ⅕~⅙ of the measure of the area of the entire loop antenna.

9. The loop antenna as claimed in claim 7, wherein the width of the gap between the third loop section and the second loop section is smaller than 1 mm.

10. The loop antenna as claimed in claim 7, further comprising a substrate, the substrate comprising a first surface and a second surface opposite to the first surface, wherein the first loop section, the second loop section and the third loop section are formed on the first surface of the substrate, a feeding via hole and a feed line are formed on the substrate, at least a portion of the feed line is formed on the second surface, the first end is coupled to the feed line through the feeding via hole, a first feed point is located on an end of the feed line, and a second feed point is located on the sixth end.

11. The loop antenna as claimed in claim 7, wherein a line width of the first loop section is greater than a line width of the second loop section.

12. The loop antenna as claimed in claim 7, wherein the empty area is rectangular, and the annular groove is a rectangular annular groove.

13. A loop antenna, comprising:

a first loop section, comprising a first end and a second end, wherein the first loop section surrounds and defines an empty area;

a second loop section, comprising a third end and a fourth end, the third end is connected to the second end, wherein the second loop section surrounds the first loop section, an annular groove is formed between the first loop section and the second loop section, the annular groove surrounds the first loop section in a rectangular path and has four sides, and a width of the annular groove is between 1 mm and 10 mm; and a third loop section, comprising a fifth end and a sixth end, the fifth end connected to the fourth end, wherein the third loop section surrounds the second loop section, and a width of a gap between the third loop section and the second loop section is smaller than the width of each of the four sides of the annular groove, wherein the first loop section extends along a rectangular path, the first loop section further comprises a parasitic structure, and the parasitic structure is formed on four sides of the first loop section, and is located in the annular groove.

* * * * *